United States Patent [19]

Uehara et al.

[11] 4,248,573

[45] Feb. 3, 1981

[54] HYDRAULIC CONTROL SYSTEM FOR VARIABLE DISPLACEMENT PUMP

[75] Inventors: Kazuo Uehara, Tokyo; Hideaki Tohma, Yokohama; Yoshito Sato, Hirakata, all of Japan

[73] Assignee: Kabushiki Kaisha Komatsu Seisakusho, Tokyo, Japan

[21] Appl. No.: 78,029

[22] Filed: Sep. 24, 1979

[30] Foreign Application Priority Data

Sep. 22, 1978 [JP] Japan ..... 53/116018

[51] Int. Cl.[3] ..... F04B 49/00

[52] U.S. Cl. ..... 417/216; 60/447; 60/486

[58] Field of Search ..... 417/216, 218–222; 60/445, 447, 449, 452, 430, 486

[56] References Cited

U.S. PATENT DOCUMENTS

| | | | |
|---|---|---|---|
| 3,732,036 | 5/1973 | Busbey et al. | 417/216 |
| 3,738,779 | 6/1973 | Hein et al. | 417/213 |
| 3,841,795 | 10/1974 | Ferre et al. | 417/216 |
| 3,935,706 | 2/1976 | Stevens | 417/218 X |
| 4,065,228 | 12/1977 | McMillan | 417/216 X |
| 4,203,712 | 5/1980 | Uehara | 60/452 X |

FOREIGN PATENT DOCUMENTS

| | | | |
|---|---|---|---|
| 55-1478 | 1/1980 | Japan | 417/216 |

*Primary Examiner*—Carlton R. Croyle
*Assistant Examiner*—Edward Look
*Attorney, Agent, or Firm*—Armstrong, Nikaido, Marmelstein & Kubovcik

[57] ABSTRACT

A hydraulic control system for a variable displacement pump, comprising a prime mover for driving the variable displacement pump, a fixed displacement pilot pump driven by the common prime mover, a pressure compensating valve connected to the pilot pump and the variable displacement pump, a cut-off control valve connected to the pressure compensating valve and the variable displacement pump, and a servo booster connected to the cut-off control valve and the pilot pump for controlling the displacement of the variable displacement pump.

7 Claims, 14 Drawing Figures

HYDRAULIC CONTROL SYSTEM FOR VARIABLE DISPLACEMENT PUMP

BACKGROUND OF THE INVENTION

This invention relates to a displacement control device for use in variable displacement pumps. The objects of the displacement control of variable displacement pumps can be broadly classified into the following three items.

(1) Displacement controls in accordance with the instruction of the operator.

(2) Controls of the input torque of the pump.

(3) Prevention of generation of excessive or overshoot pressures.

The prior art devices have been disadvantageous in that they can meet the above-mentioned requirements individually, however, cannot satisfy all such requirements.

In case of the control device comprising linkages and cams, controls cannot be made to limit the total input torque of a plurality of variable displacement pumps, and the prior art control devices for limiting the total input torque of a plurality of variable displacement pumps requires the condition that the displacements of respective pumps are equal, and therefore they cannot meet the requirements in the above-mentioned items (1) and (3).

SUMMARY OF THE INVENTION

It is therefore an object of the present invention to provide a hydraulic control system for variable displacement pumps in which displacement volume can be controlled by the instructions of an operator.

Another object of the present invention is to provide a hydraulic control system for variable displacement pumps in which the total input torque to a plurality of pumps can be controlled and limited.

A further object of the present invention is to provide a hydraulic control system for variable displacement pumps in which an excessive pressure overshoot can be prevented without causing significant energy losses.

A still further object of the present invention is to provide a hydraulic control system for variable displacement pumps in which displacement volume becomes minimum when the pumps are out of operation thereby improving the starting up characteristic of a prime mover.

It is a still further object of the present invention to provide a hydraulic control system for variable displacement pumps which can shorten the warming-up time by using a particular warming-up circuit.

In accordance with an aspect of the present invention, there is provided a hydraulic control system for a variable displacement pump, comprising in combination: prime mover means for driving said variable displacement pump; a fixed displacement pilot pump driven by said common prime mover means; pressure compensating valve means connected to the delivery side of said pilot pump and to said variable displacement pump through a first pilot circuit, said pressure compensating valve means being adapted to prevent said prime mover means from being imposed an excessive load; cut-off control valve means connected to said pressure compensating valve means and to said variable displacement pump through a second pilot circuit, said cut-off control valve means being adapted to limit the supply pressure from said pressure compensating valve means under pre-set cut-off valve thereof; and servo booster means connected to said cut-off control valve means and said pilot pump for controlling the displacement of said variable displacement pump. A neutral control valve which is old in the art may be disposed between the cut-off control valve means and the servo booster means.

Preferably, a plurality of variable displacement pumps are provided in the system and the same number of cut-off control valve means, neutral control valve means and servo booster means are arranged in parallel for controlling the displacement of the respective variable displacement pumps.

The above and other objects, features and advantages of the present invention will be readily apparent from the following description taken in conjunction with the accompanying drawings.

DETAILED DESCRIPTION OF THE INVENTION

Figure 1:
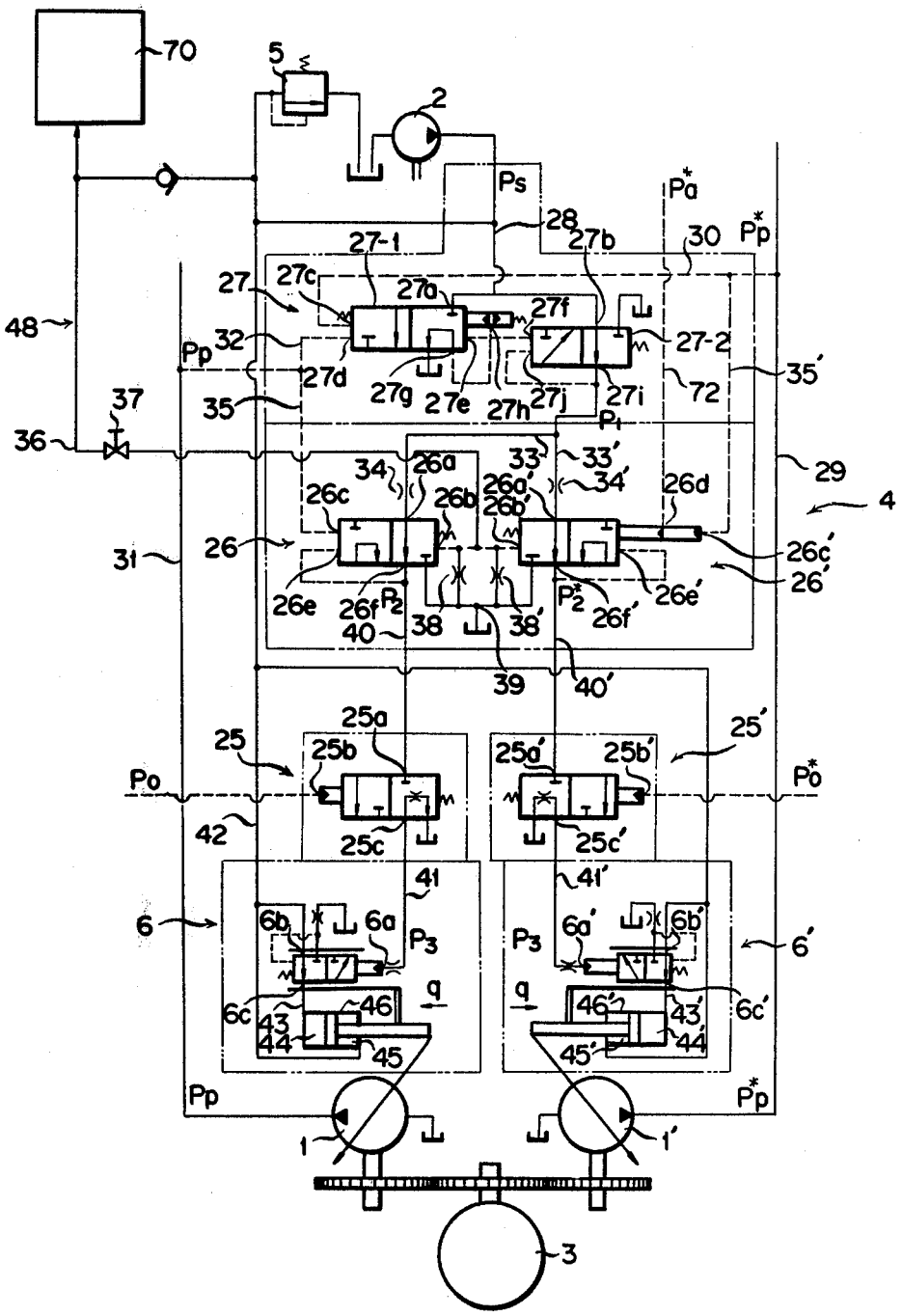
FIG. 1 is a hydraulic circuit showing an overall hydraulic control system according to the present invention.

The present invention will now be described in detail with reference to the accompanying drawings.

In the drawings, reference numerals 1 and 1' denote variable displacement pumps, and 2 a fixed displacement pilot pump. These pumps 1, 1' and 2 can be driven or rotated by the same prime mover 3.

The variable displacement pump 1 is adapted to supply pressurized fluid to first and second actuators (not shown), and the variable displacement pump 1' is adapted to supply pressurized fluid to third and fourth actuators (not shown). The pilot pump 2 is arranged to supply fluid under pressure to a pilot control system 70 associated with a displacement control means 4 of the variable displacement pumps 1 and 1' and the actuators. The delivery pressure $P_S$ of the pilot pump 2 can be set by means of a relief valve 5.

Reference numerals 6 and 6' denote servo booster means for controlling the displacement Q and Q* of the variable displacement pumps 1 and 1', respectively.

Further, reference numerals 25 and 25' indicate neutral control valves (referred to as NC valves hereinafter), respectively.

Reference numerals 26 and 26' denote cut-off control valves, and 27 a pressure compensating valve.

The delivery side of the fixed displacement pilot pump 2 is connected through a conduit 28 with ports **27*a* and 27*b* of two-stage proportional pressure reducing valve 27-1 and negative proportional pressure reducing valve 27-2, respectively, of the pressure compensating valve 27. The negative proportional pressure reducing valve as used herein means a pressure reducing valve wherein sum of the output pressure therefrom and the output pressure of two-stage proportional pressure reducing valve 27-2 is constant. A port 27*c* of the two-stage proportional pressure reducing valve 27-1 is connected through a pilot conduit 30 with a delivery conduit 29 of the variable displacement pump 1'**.

Further, the reducing valve 27-1 has a port **27*d* which is connected through a pilot conduit 32 with a delivery conduit 31 of the variable displacement pump 1**.

A port **27*e* of the two-stage proportional pressure reducing valve 27-1 is connected with a port 27*f* of the negative proportional pressure reducing valve 27-2. These ports 27*e* and 27*f* communicate with ports 27*g* and 27*h* of the two-stage proportional pressure reducing valve 27-1**.

A port **27*i* of the pressure compensating valve 27 is connected with a port 27*j* of the negative proportional pressure reducing valve 27-2**.

The port **27*i* of the pressure compensating valve 27 is connected through conduits 33 and 33' with inlet ports 26*a* and 26*a'* of the cut-off control valves 26 and 26', respectively. Further, the conduits 33 and 33' are provided with restrictors 34 and 34'**, respectively.

The cut-off control valve 26 has a port **26*c* which is connected through a pilot conduit 35 with the delivery conduit 31, and a port 26*b* which is connected through a conduit 36 with the delivery side of the pilot pump 2, the conduit 36 being provided with a warming-up cock 37, thereby forming a warming-up circuit 48. Further, the port 26*b* is connected through a restrictor 38 with a drain circuit 39**.

Another cut-off control valve 26' has a port **26*c'* which is connected through a pilot conduit 35' with the aforementioned delivery conduit 29, and a port 26*d* which is connected through a pilot conduit 72 with the second actuator (not shown). Further, the cut-off control valve 26' has a port 26*b'* which is connected through the conduit 36 with the pilot control system 70. The port 26*b'* is connected through a restrictor 38' with the drain circuit 39. Further, the cut-off control valves 26 and 26' have changeover pilot ports 26*e* and 26*e'* which communicate with their outlet ports 26*f* and 26*f'***, respectively.

The outlet port **26*f* of the cut-off control valve 26 is connected through a conduit 40 with an inlet port 25*a* of the NC valve 25. The NC valve 25 has a pilot port 25*b* in which the output pressure $P_o$ deliverred by the pilot control system 70** is introduced.

The outlet port **26*f'* of the cut-off control valve 26' is connected through a conduit 40' with an inlet port 25*a'* of the NC valve 25'. The NC valve 25' has a pilot port 25*b'*** in which the output pressure $P_o$* sent from the pilot control system 70 is introduced.

The NC valve 25 has an outlet port **25*c* which is connected through a conduit 41 with a pilot port 6*a* of the servo booster means 6. The servo booster means 6 has a port 6*b* which is connected with a delivery conduit 42 of the pilot pump 2, and a port 6*c* which is connected through a conduit 43 with a pressure chamber 44 of a servo cylinder 46. The pressure chamber 45 of the servo cylinder 46 on the other side thereof is connected with the delivery conduit 42**.

Another NC valve 25' has an outlet port **25*c'* which is connected through a conduit 41' with a pilot port 6*a'* of another servo booster means 6'. The servo booster means 6' has a port 6*b'* which is connected with the delivery conduit 42 of the pilot pump 2, and a port 6*c'* which is connected through a conduit 43' with a pressure chamber 44' of the servo cylinder 46'. A pressure chamber 45' of the servo cylinder 46' on the other side thereof is connected with the delivery conduit 42**.

Figure 2:
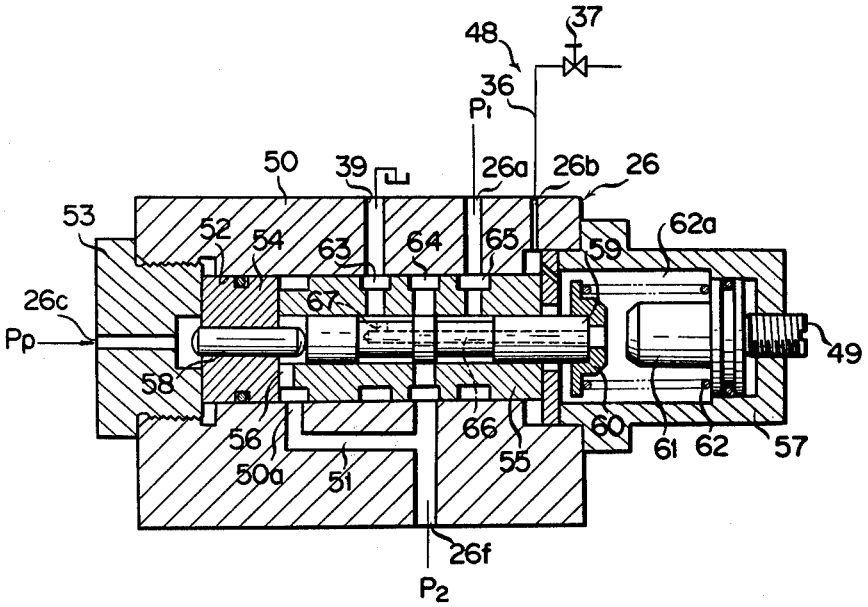
FIG. 2 is a cross-sectional view of a cut-off control valve employed in the present invention.

The aforementioned cut-off control valve 26 comprises, as shown in FIG. 2, a housing 50 which has an inlet port **26*a*, a port 50*a*, an outlet port 26*f* and a drain port 39 formed therein. The port 50*a* communicates through a feed-back circuit 51 with the outlet port 26*f*. The housing 50 has a bore 52, one end of which is fitted with a plug 53 having a pump port 26*c* formed therein. Sleeves 54 and 55 are fitted in the bore 52, and the sleeve 55 has a guide hole 56 communicating with the port 50*a*. Fixedly secured to the other end of the housing 50 is a cylindrical member 57. A pin 58 and a spool 59 are slidably mounted within the sleeves 54 and 55, respectively, the spool 59 having at one end thereof a spring retainer 60** fitted thereto.

Movably mounted within the cylindrical member 57 is a piston-shaped stopper 61, and the cylindrical member 57 is provided with an adjusting screw 49. A spring 62 is interposed between the spring retainer 60 and the stopper 61.

The sleeve 55 has ports 63, 64 and 65 formed therein and the spool 59 has a passage 66 and a restrictor 67 formed therein. The valve housing 50 has the port **26*b* leading to a pressure chamber 62*a*. The operation of the above-mentioned cut-off control valve 26** will be described below.

When the pump delivery pressure $P_p$ of the variable displacement pump 1 rises, the spool 59 is moved through the pin 58 to the right against the biasing force of the spring 62. As a result, the communication of the port **26*a* with the port 26*f* is cut off and the port 26*f* is allowed to communicate with the drain port 39** to reduce the supply pressure $P_2$ thereby reducing the displacement of the variable displacement pump.

Reversely, when the pump delivery pressure $P_p$ falls as compared with the force of the spring set by the adjusting screw 49, the spool 59 is moved back to the left thereby allowing communication between the ports **26*a* and 26*f* and cutting off the communication between the port 26*f* and the drain port 39** thereby increasing the supply pressure $P_2$ and hence increasing the displacement of the variable displacement pump.

If, upon the increase of the displacement of the pump, the response of the cut-off control valve 26 is increased, the supply pressure $P_2$ tends to become excessive and unstable, resulting in hunting of the variable displacement pump 1.

For the purpose of preventing the overshoot or excessive increase of the supply pressure $P_2$, the supply pressure $P_2$ is introduced into a space formed between the pin 58 and the spool 59 by way of the feed back circuit 51. Since the diameter of the spool 59 is larger than that of the pin 58, when the supply pressure $P_2$ become excessive, the spool 59 is moved to the right against the force of the spring 62. As a result, the communication between the ports 26*a* and 26*f* is cut off and the port 26*f* is allowed to communicate with the drain port 39 so that the supply pressure $P_2$ is released into the drain circuit thereby relieving the excessive pressure rise and preventing the generation of hunting of the variable displacement pump.

Figure 3:
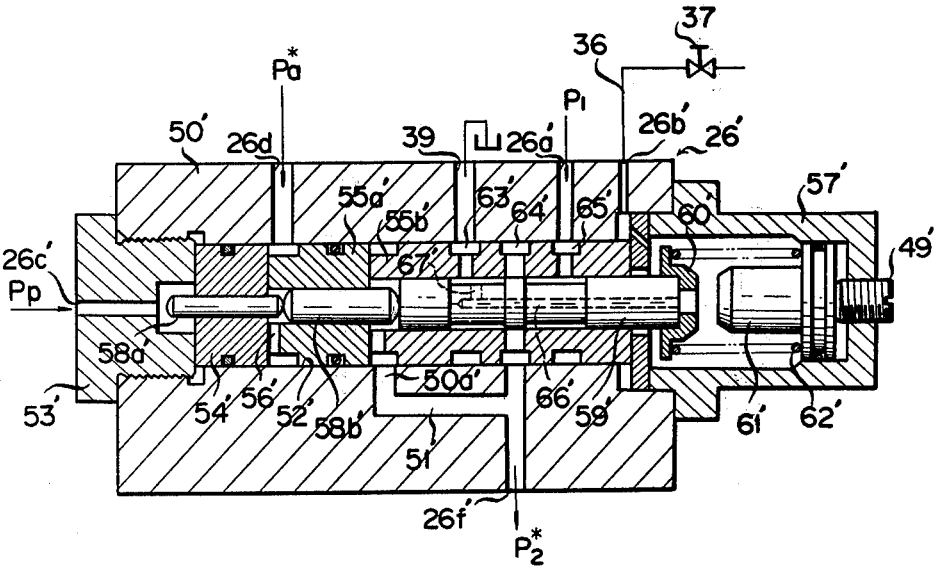
FIG. 3 is similar to FIG. 2 but showing another type of cut-off control valve.

The aforementioned another cut-off control valve 26' comprises, as shown in FIG. 3, a housing 50' which has formed therein an inlet port 26*a'*, a pressure port 26*d*, outlet ports 26*f'* and 50*a'* and a drain port 39. The outlet port 50*a'* communicates through a feed-back circuit 51' with the outlet port 26*f'*. The housing 50' has a bore 52', one end of which is provided with a plug 53' having a pump port 26*c'* formed therein. Sleeves 54', 55*a'* and 55*b'* are mounted in the bore 52', and the sleeve 55*a'* has formed therein a guide hole 56' which leads to the pressure port 26*d*. The housing 50' has a cylindrical member 57' fixedly secured to the other end thereof.

Pins 58*a'*, 58*b'* and a spool 59' are slidably mounted in the sleeves 54', 55*a'* and 55*b'*, respectively, the spool 59' having a spring retainer 60' fitted to the end thereof.

Movably mounted within the cylindrical member 57' is a piston-shaped stopper 61'. The cylindrical member 57' is provided with an adjusting screw 49' adapted to abut against the stopper 61'. A spring 62' is interposed between the spring retainer 60' and the stopper 61'.

The above-mentioned sleeve 55*b'* has ports 63', 64' and 65' formed therein, and the spool 59' has a passage 66' and a restrictor 67' formed therein.

The operation of the cut-off control valve 26' thus constructed will now be described below.

When the pump delivery pressure $P_p$ is low, the spool 59' is urged by the spring 62' to the left thereby communicating the port 26*a'* with the port 26*f'* and disconnecting the port 26*f'* from the drain port 39. Therefore, the output pressure in the port 26*f'* or the supply pressure $P_2$* is equal to the supply pressure $P_1$ in the port 26*a'*.

When the working pressure $P_a$* of the actuator introduced into the port 26*d* is zero and if the pump delivery pressure $P_p$ has reached to $P_{p.2}$*, the spool 59' is moved through the pins 58*a'* and 58*b'* to the right against the biasing force of the spring 62'. As a result, the communication between the ports 26*a'* and 26*f'* is cut off, and the port 26*f'* is allowed to communicate with the drain port 39 thereby reducing the output pressure $P_2$*. The value of $P_{p.2}$* depends on the outside diameter of the pin 58*a'* and the force of the spring set by the adjusting screw 49'.

In the case the actuator is rendered operative to obtain the relationship $P_a^* = P_p$ and when the pump delivery pressure $P_p$ has reached $P_{p.1}$*, the spool 59' is moved through the pin 58*b'* to the right thereby reducing $P_2$* in accordance with the same operational principle as mentioned hereinabove. The value of $P_{p.1}$* is determined by the outside diameter of the pin 58*b'*, and if the outside diameter of the pin 58*b'* is larger than that of the pin 58*a'*, the relationship $P_{p.1}^* < P_{p.2}^*$ can be obtained.

The outside diameter of the spool 59' is larger than that of the pin 58*b'* and the output pressure $P_2$* is introduced into the space between the spool 59' and the pin 58*b'* by the feed-back circuit 51', and therefore if the value of $P_2$* becomes excessive, the spool 59' is moved to the right so that $P_2$* can be automatically reduced thereby preventing the occurrence of hunting of the pump.

Figure 4:
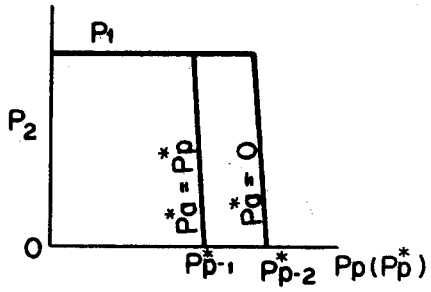
FIG. 4 is a diagram showing characteristic features of a cut-off control valve wherein $P_p$* is the output pressure of a variable displacement pump, $P_2$ is the output pressure of the cut-off control valve and $P_a$* is the supply pressure from an actuator.
Figure 5:
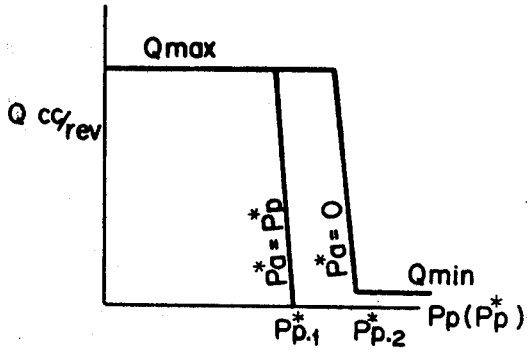
FIG. 5 is a diagram explaining how the cut-off displacement control is performed according to the present invention wherein Q is the displacement volume of a variable displacement pump.

Since the servo booster means 6 and 6' control the displacement of the variable displacement pumps 1 and 1' in accordance with the values of $P_2$ and $P_2$*, the combination of the aforementioned cut-off control valves 26 and 26' with the servo booster means 6 and 6' enables the cut-off control of displacement of the variable displacement pump as shown in FIGS. 4 and 5 to be effected.

Figure 6:
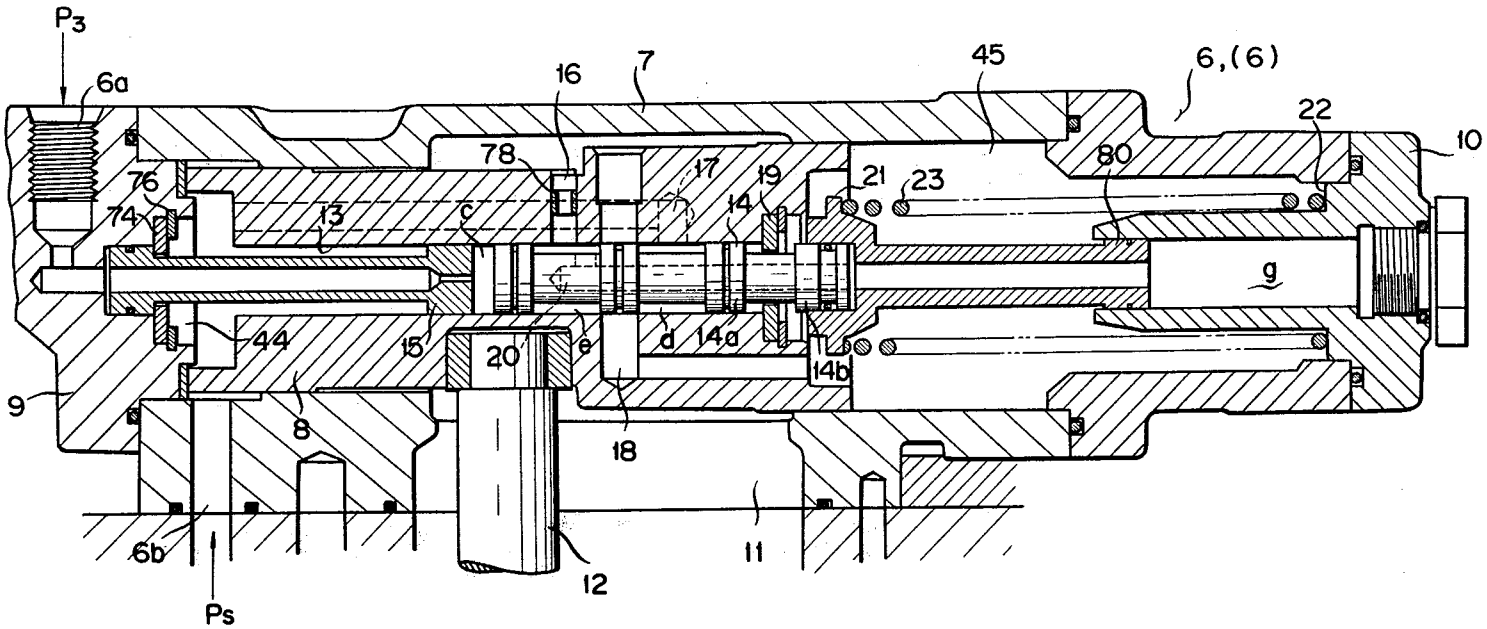
FIG. 6 is a longitudinal cross-sectional view of a servo booster employed in the present invention.

The above-mentioned servo booster means 6 and 6' each comprises a servo cylinder 7 as shown in FIG. 6. Slidably mounted within the servo cylinder 7 is a servo piston 8. The servo cylinder 7 has an end cover 9 fixedly secured to one end thereof and a sleeve 10 fixedly secured to the other end thereof. The servo cylinder 7 has an axially elongated hole 11 formed therein. Inserted in the hole 11 is a servo pin 12 which is connected to the servo piston 8.

The servo piston 8 has formed therein a bore 13 in which a pilot spool 14 and a guide tube 15 are mounted. One end of the guide tube 15 is fixedly secured to the end cover 9 by means of a retainer member 74 and a snap ring 76, and the inside of the guide tube 15 communicates with the port 6*a* formed in the end cover 9. The servo piston 8 has formed therein a drain port 16 extending from the outer peripheral surface thereof to the bore 13, a port 17 leading to a pressure chamber 44 and a port 18 leading to a pressure chamber 45, the drain port 16 having a restrictor 78 formed therein.

The servo piston 8 has a stopper 19 located between lands 14*a* and 14*b* of the pilot spool 14. Fitted to the end of the pilot spool 14 is one end of a slide tube 80, the other end of which is slidably mounted in the sleeve 10.

The inside of the slide tube 80 communicates with an inner passage 20 opening in the outer peripheral face of the pilot spool 14.

Further, the slide tube 80 has a spring seat 21 integrally formed therewith, and a spring 23 is mounted between the spring seat 21 and a spring seat 22 which is formed integrally with the sleeve 10. The above-mentioned servo pin 12 is connected to swash plates of the variable displacement pumps 1 and 1'. Reference numeral 6*b* denotes a port in which a pilot pressure is introduced.

The operation of the servo booster means 6 and 6' thus constructed will now be described below. In brief, a pilot pressure $P_s$ is supplied into the inlet port 6*b* of the pressure chamber 44 of the servo piston 8 formed on one end thereof. A supply pressure $P_3$ is supplied through the port 6*a* into a pressure chamber c formed between the guide tube 15 and the pilot spool 14. A chamber g defined within the sleeve 10 communicates through the inner passage 20 of the pilot spool 14 with the drain port 16.

The above-mentioned pressure chamber 44 communicates through the port 17 with a chamber d, and the pressure chamber 45 defined on the other side of the servo piston 8 communicates with the port 18.

When the supply pressure $P_3$ rises, the pilot spool 14 is moved to the right against the biasing force of the spring 23 thereby communicating the port 18 with the drain port 16 to drain the hydraulic fluid within the pressure chamber 45 through the restrictor 78 of the drain port 16. Consequently, the servo piston 8 will move following the movement of the pilot spool 14.

Because the pilot spool is displaced to the right in response to a rise in pilot pressure against the biasing force of the spring 23, the displacement volume of the variable displacement pump is set by the supply pressure $P_3$.

When the supply pressure $P_3$ rises suddenly, the pressure in the chamber e is increased by the restrictor means 78 of the drain port 16, and the pressure rise is transmitted to the chamber g of the sleeve 10. Therefore, the higher the rightward moving speed of the servo piston 8 becomes, the larger the leftward returning force of the pilot spool 14 becomes, thus the increasing speed of the displacement of the variable displacement pump is limited.

Reversely, when the supply pressure $P_3$ falls suddenly, the pilot spool 14 is moved back to the left by the action of the spring 23 thereby communicating the port 18 with the port 17 to supply the pilot pressure $P_s$ into the pressure chamber 45 and allow the servo piston 8 to follow the pilot spool 14.

Because, in this case, the flow rate of the fluid passing through the restrictor 78 is reduced to a large extent, the pressure inside the chamber g of the sleeve 10 is maintained at the drain pressure regardless of the speed of movement of the servo piston 8.

Therefore, the pilot spool 14 is not influenced by the moving speed of the servo piston 8, and so the displacement reduction speed of the pump is not subjected to any restriction.

When the pump is stopped, the displacement of the pump is set to its minimum by the spring 23. Thus, by driving or rotating the variable displacement pumps 1 and 1' and the pilot pump 2, the supply pressure $P_s$ deliverred by the pilot pump 2 will pass through the pressure compensating valve 27 via the conduit 28 to produce the supply pressure $P_1$.

Figure 7:
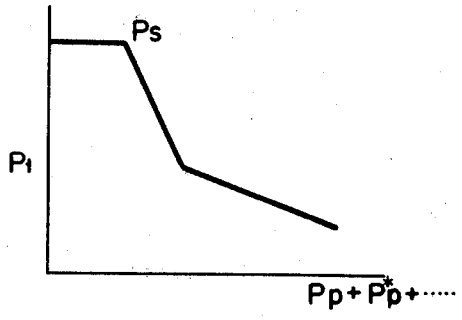
FIGS. 7 to 9 are diagrams showing characteristic features of a pressure compensating valve employed in the present invention wherein $P_s$ is the output pressure of a fixed displacement pilot pump.
Figure 8:
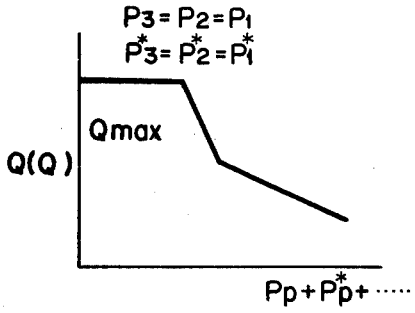
Figure 9:
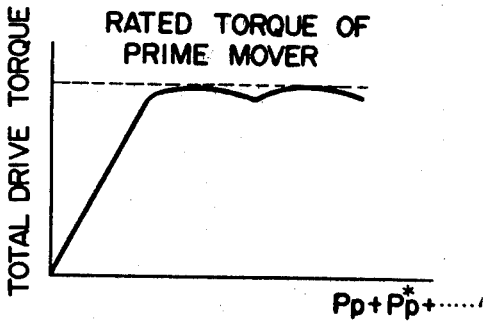
Figure 10:
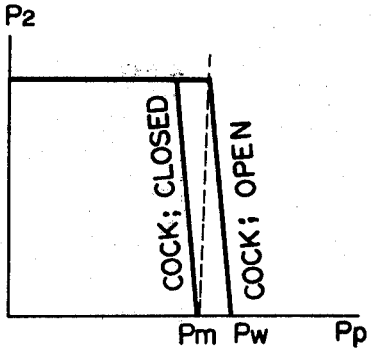
FIGS. 10 and 11 are similar to FIGS. 4 and 5, respectively, but showing characteristic features of a cut-off control valve connected to a warming-up circuit.

The pressure compensating valve 27 has the characteristics shown in FIG. 7 and is adapted to operate so as not to apply an excessive load on the prime mover 3 and is adapted to utilize the output of the prime mover to the fullest extent against a wide range of loading pressures (See FIGS. 8 and 9).

The supply pressure $P_1$ set by the pressure compensating valve 27 is supplied into the cut-off control valves 26 and 26'. The cut-off control valve 26 has the characteristics as shown in FIGS. 4 and 5 when $P_a$* is zero and prevents generation of an excessive pressure in the hydraulic system and reduces the amount of the fluid to be relieved to its minimum thereby reducing the horsepower loss. Further, the supply pressure $P_2$ set by the cut-off control valve 26 will not exceed the supply pressure $P_1$, and therefore no excessive load is applied to the prime mover.

Another cut-off control valve 26' serves to detect not only the delivery pressure $P_p$* of the variable displacement pump 1' but also the working pressure $P_a$* of a particular actuator and reduce the cut-off values as shown in FIGS. 4 and 5 when the particular actuator is rendered operative. Whether the cut-off control valve 26' is used or not is determined by the balance between the functions of the actuators.

Further, when the warming-up cock 37 is opened, the pilot pressure $P_s$ is introduced into the spring chambers **62*a* and 62*a'*, and because of the action of the restrictors 67 and 67' between the guide holes 66 and 66' and the drain port 39, the pressure within the spring chambers 62*a* and 62*a'* will increase and reach the pilot pressure $P_s$. As a result, the forces urging the spools 59 and 59' will increase, and so $P_p$ will reach $P_w$ ($P_w > P_m$) and then move the spools 59 and 59'** to the right.

Figure 11:
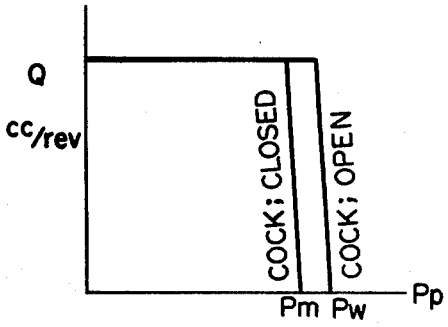

Accordingly, in this case, when $P_p$ has reached $P_w$, $P_2$ and $P_2$* will fall (Refer to FIG. 11).

Because the outside diameters of the spools 59 and 59' are larger than those of the pins 58 and **58*b'*** and the supply pressures $P_2$ and $P_2$* are introduced through the feedback circuits 51 and 51' into the space between the spool 59 and the pin 58 and into the space between the spool 59' and the pin **58*b'*** when $P_2$ and $P_2$* becomes excessive, the spools 59 and 59' will be moved to the right so as to enable $P_2$ and $P_2$* to be automatically reduced thereby achieving an effective pressure compensation.

Since the servo booster means 6 and 6' control the displacement $Q^{cc}$/rev. of the variable displacement pumps 1 and 1' in accordance with the values of $P_2$ and $P_2$*, the combination of the aforementioned cut-off control valves 26 and 26' with the servo booster means 6 and 6' enables the cut-off control of displacement of the variable displacement pumps to be made as shown in FIG. 11. In this figure, dotted line shows a characteristic line of a main relief valve (not shown).

If the cracking pressure of the main relief valve is set at $P_m$ and when the warming-up cock 37 is closed, the cut-off control of the pump is made before the cracking of the main relief valve occurs, and so the energy loss caused by the main relief valve can be reduced.

When the warming-up cock 37 is opened, cracking of the main relief valve will occur before the cut-off control of the pump is made thereby increasing the energy loss due to the main relief valve and shortening the time for warming up the hydraulic system.

Subsequently, the supply pressures $P_2$ and $P_2$* set by the cut-off control valves 26 and 26' are introduced into the neutral control valves (NC valves) 25 and 25', respectively.

The NC valves 25 and 25' are actuated, respectively, by the output signals produced by the pilot control system 70 to convert the respective supply pressures $P_2$ and $P_2$* into $P_3$ and $P_3$* which are introduced into the servo booster means 6 and 6', respectively.

The operation of the servo booster means 6 and 6' are as described hereinbefore, and the displacements Q and Q* of the variable displacement pumps 1 and 1' can be controlled individually by the servo booster means 6 and 6', respectively.

Figure 12:
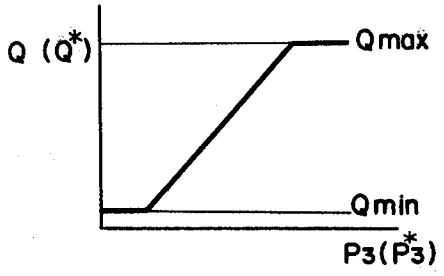
FIG. 12 is a diagram showing characteristic features of a servo booster employed in the present invention.

The displacements Q and Q* of the variable displacement pumps 1 and 1' are controlled by the supply pressures $P_3$ and $P_3$*, respectively (Refer to FIG. 12).

Accordingly, the above-mentioned displacements Q and Q* are controlled by the hydraulic circuits controlling the supply pressures $P_3$ and $P_3$*. In this case, there is no need of providing complex mechanism such as feed-back linkages.

Figure 13:
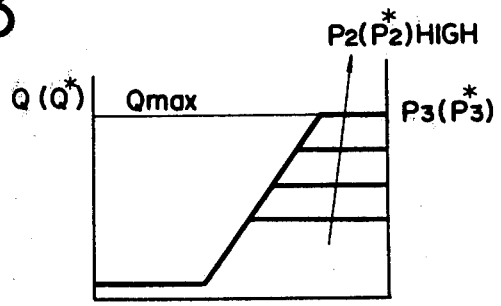
FIG. 13 is a diagram showing characteristic features of a neutral control valve employed in the present invention.

The supply pressures $P_3$ and $P_3$* are set by the output pressures $P_o$ and $P_o$* of the pilot control system 70 determined by the manipulation of the operator through NC valves 25 and 25' and will not exceed the supply pressures $P_2$ and $P_2$* of NC valves 25 and 25' (Refer to FIG. 13).

Figure 14:
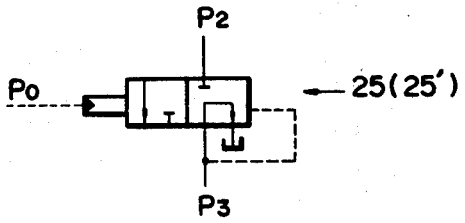
FIG. 14 is a graphical symbol of another type of neutral control valve.

Although throttle valves are employed as NC valves 25 and 25', reducing valves as shown in FIG. 14 may be used instead, and as the case may be, proportionally controlled electromagnetic valves may be used.

In this case, the operator can adjust the speed of the actuator easily, and also no excessive loading is applied to the hydraulic system.

According to the displacement control device of the present invention, the displacement control of the variable displacement pump in accordance with the operator's instruction, limitation of the input torque of the pump and prevention of generation of excessive pressures can be effected at the same time. Further, because the displacement of the variable displacement pump when it is stopped can be reduced to its minimum, the starting characteristics of the prime mover can be improved, and also the setting of the supply pressures can be varied depending on the kind of actuators. Still further, by opening the warming-up cock, the warming-up time can be shortened and also the oil temperature can be raised to reduce the viscosity of the oil thereby enabling an improved starting characteristic of the engine to be obtained even in cold districts.

It is to be understood that the foregoing description is merely illustrative of a preferred embodiments of the invention, and that the scope of the invention is not to be limited thereto, but is to be determined by the scope of the appended claims.

What we claim is:

1. A hydraulic control system for a variable displacement pump, comprising:

prime mover means for driving said variable displacement pump;

a fixed displacement pilot pump driven by said prime mover means;

pressure compensating valve means connected to the delivery side of said pilot pump and to said variable displacement pump through a first pilot circuit, said pressure compensating valve means being adapted to prevent said prime mover means from being imposed an excessive load;

cut-off control valve means connected to said pressure compensating valve means and to said variable displacement pump through a second pilot circuit, said cut-off control valve means being adapted to limit the supply pressure from said pressure compensating valve means under pre-set cut-off value thereof; and servo booster means connected to said cut-off control valve means and said pilot pump for controlling the displacement of said variable displacement pump.

2. A hydraulic control system as recited in claim 1 further comprising neutral control valve means disposed between said cut-off control valve means and said servo booster means.

3. A hydraulic control system as recited in claim 1 or 2 further comprising a warming-up circuit including warming-up cock means disposed between said pilot pump and said cut-off control valve means for directly introducing the output pressure of said pilot pump into said cut-off control valve means when the warming-up cock is opened thereby adjusting cut-off value of said cut-off control valve means above a working line pressure set by a relief valve.

4. A hydraulic control system as recited in claim 3 further comprising a pilot control circuit connected to said pilot pump, said pilot control circuit being adapted to supply its output pressure to said neutral control valve means.

5. A hydraulic control system as recited in claim 1 or 2 wherein said pressure compensating valve means comprises a proportional pressure reducing valve connected to said pilot pump and a negative proportional pressure reducing valve connected to said proportional pressure reducing valve and said cut-off control valve means.

6. A hydraulic control system as recited in claim 2 wherein a plurality of variable displacement pumps are provided in the system and wherein corresponding number of cut-off control valve means, neutral control valve means and servo booster means to that of variable displacement pumps are arranged in parallel for controlling the displacement of the respective variable displacement pumps.

7. A hydraulic control system as recited in claim 2 wherein said servo booster means comprises servo pilot-operated spool valve means connected to said neutral control valve means and operated by the hydraulic fluid therefrom, said servo pilot-operated spool valve means being connected to said pilot pump, and servo cylinder means having a piston mounted therein, the piston being mechanically connected to said variable displacement pump for controlling the displacement therefrom.

* * * * *